United States Patent [19]

Kleinhans

[11] Patent Number: 4,803,963

[45] Date of Patent: Feb. 14, 1989

[54] AUTOMATIC PRIMING SYSTEM FOR A MARINE ENGINE

[75] Inventor: Kenneth L. Kleinhans, North Fond du Lac, Wis.

[73] Assignee: Brunswick Corporation, Skokie, Ill.

[21] Appl. No.: 179,964

[22] Filed: Apr. 11, 1988

[51] Int. Cl.[4] ..... F02M 1/10

[52] U.S. Cl. ..... 123/187.5 R; 123/180 T

[58] Field of Search ..... 123/187.5 R, 180 T, 123/179 G, 179 A

[56] References Cited

U.S. PATENT DOCUMENTS 1,091,092 3/1914 Tate ..... 123/187.5 R
3,307,836 3/1967 Arndt et al. ..... 123/187.5 R
3,361,124 1/1968 Fend ..... 123/179 G
4,194,483 3/1980 McChesney et al. ..... 123/187.5 R

*Primary Examiner*—Andrew M. Dolinar
*Attorney, Agent, or Firm*—Andrus, Sceales, Starke & Sawall

[57] ABSTRACT

An automatic priming system for an outboard marine engine includes a pneumatic cylinder operably connected to the recoil pulley of the engine. The pneumatic cylinder is charged by the rotation of the pulley and the increased pressure is communicated to a second pneumatic cylinder that is operably connected to the primer button of the engine. Thus, rotation of the recoil pulley results in an automatic depressing of the primer button.

9 Claims, 1 Drawing Sheet

AUTOMATIC PRIMING SYSTEM FOR A MARINE ENGINE

BACKGROUND OF THE INVENTION

The present invention relates to a priming system for a marine engine and more specifically to an automatic priming system for an outboard marine engine of the type utilizing a manual pull start having a rope wound recoil pulley.

In outboard marine engines of the type that are started by pulling on a starter rope, it is usually necessary to prime the engine prior to attempting to start it. This is typically done by depressing a primer button that is connected to a primer bowl on the carburetor of the marine engine. This is typically done manually and if the priming is omitted or if the engine is "over primed" it may be difficult to start the engine.

Therefore, it is an object of the present invention to provide an automatic priming system for an outboard marine engine that will automatically prime the engine upon pulling of the starter rope.

It is a further object of the present invention to provide an automatic priming system that will sense a warm or heated engine condition and will eliminate the priming step upon sensing this condition.

SUMMARY OF THE INVENTION

An automatic priming system for an outboard marine engine of the type utilizing a manual pull start having a rope wound recoil pulley with a series of camming surfaces about its circumference includes a cam lever that is engageable with the camming surfaces and is pivotally mounted so that movement of the first end of the lever over the camming surfaces causes a corresponding movement of the second end of the lever.

The priming system is further provided with a pneumatic cylinder having a cylinder rod connected to the second end of the cam lever in such a manner that movement of the cam lever causes an increase in pressure in the fluid contained within the pneumatic cylinder.

In accordance with yet another aspect of the invention, the system is provided with a second pneumatic cylinder that is operably connected to the first pneumatic cylinder in such a manner that the pressure is communicated to the head side of the second cylinder so as to cause extension of the second cylinder rod upon pressurization of the first pneumatic cylinder.

The piston rod for the second cylinder engages the primer button so that extension of the cylinder rod causes depression of the primer button.

In accordance with yet another aspect of the invention, the system is provided with a temperature activated valve that moves to an open position upon sensing a high engine temperature. In its open position, the pneumatic pressure generated by the first pneumatic cylinder is vented to the atmosphere so that a warm engine will not be primed during restarting.

The present invention thus provides a system for automatically priming a marine outboard engine upon pulling of the starter rope so that it is unnecessary to manually prime the engine prior to starting.

The present invention also provides a system that automatically eliminates the priming procedure upon sensing a warm engine condition so that the engine will not be primed during the restarting of a warm engine.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
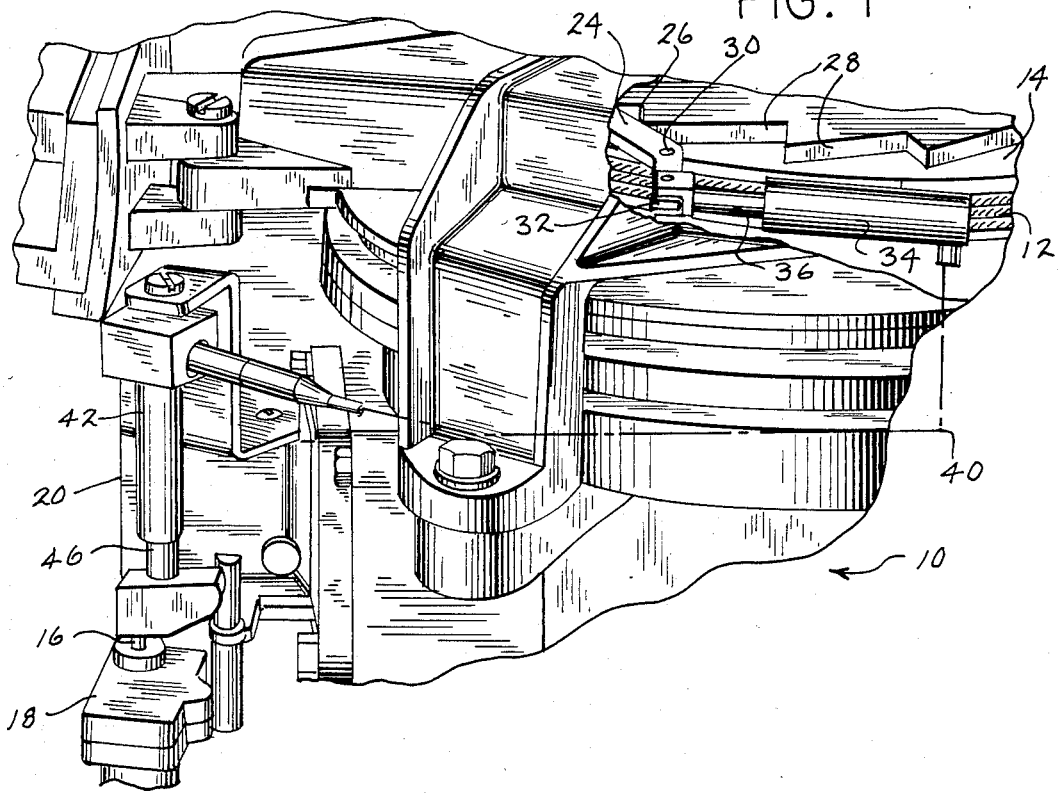
FIG. 1 is a perspective view with parts broken away of an outboard marine engine constructed according to the invention.

As seen in FIG. 1, an outboard marine engine 10 is started by pulling the handle 11 of a starter rope 12 that is wound around recoil pulley 14.

Prior to cold starting marine engine 10, it is necessary to provide additional fuel by priming the engine. This is done by depressing primer button 16 on primer bowl 18 in order to pump additional fuel into carburetor 20. In the past, primer button 16 was manually depressed. Primer button 16 is biased to its upward position so that it will return to its raised position when released.

The automatic priming system 22 includes a cam lever 24 having a first end 26 that engages a series of camming surfaces 28 located along the upper surface and circumference of recoil pulley 14. Cam lever 24 is pivotally mounted at pivot point 30 so that the second end 32 of cam lever 24 will be moved by the movement of first end 26 as it follows camming surfaces 28.

Automatic priming system 22 is further provided with a first pneumatic cylinder 34 in which piston rod 36 is pivotally connected to second end 32 in such a manner that the movement of second end 32 will cause piston head 38 to pressurize the fluid within cylinder 34. The increased pressure in cylinder 34 is transmitted through conduit 40 to the head side of second pneumatic cylinder 42. The pressure acts on piston head 44 and causes extension of piston rod 46. The end of piston rod 46 is in engagement with primer button 16 so that the extension of rod 46 will cause the depressing of primer button 16 and the priming of engine 10.

Conduit 40 is provided with a one-way valve 48 that allows the pressure from cylinder 34 to be communicated to cylinder 42 but will not allow a return flow of pneumatic fluid from cylinder 42 to cylinder 34.

Figure 2:
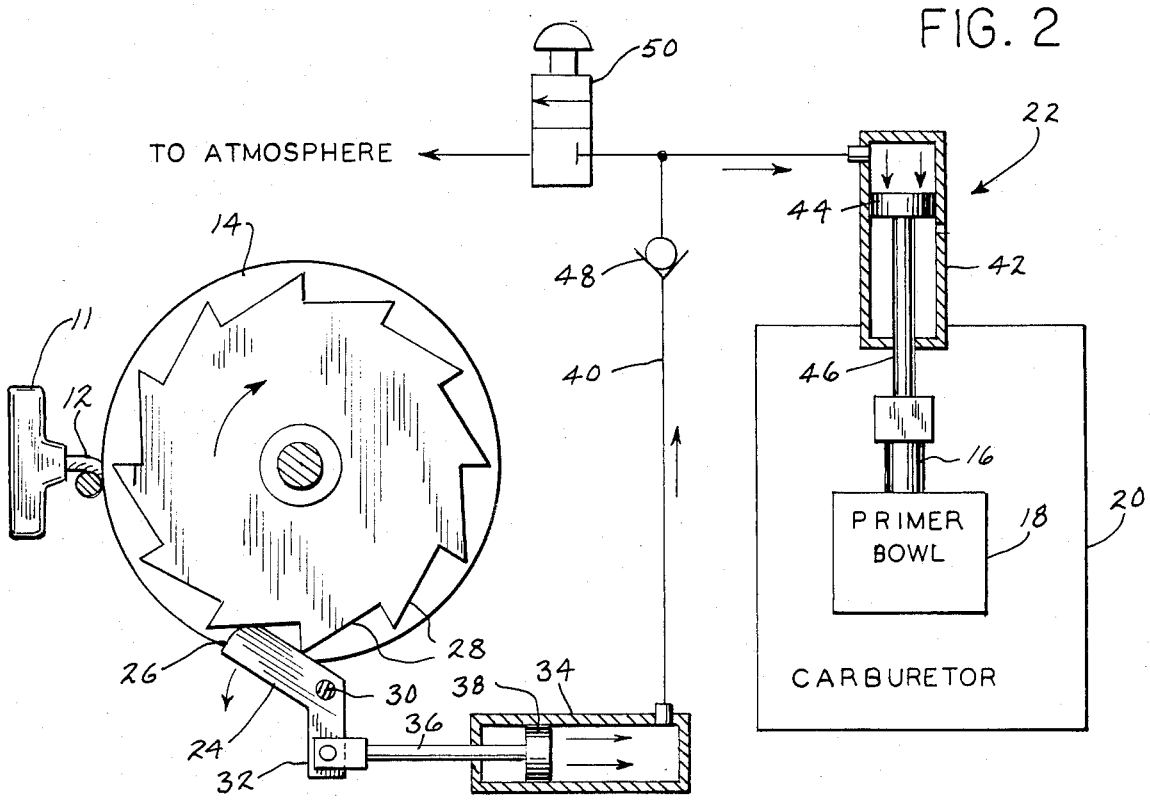
FIG. 2 is a schematic of an automatic priming system constructed according to the invention.

Conduit 40 is also provided with a temperature activated valve 50 that at cold engine temperatures is in a closed position such as that shown in FIG. 2. However, upon sensing a high temperature such as that which would be associated with an engine that had been running for some time, the valve moves to an open position so that increased pneumatic pressure from cylinder 34 is vented to the atmosphere. This venting of the increased pressure prevents additional priming of the engine when a warm engine is being restarted.

It is recognized that various alternatives and modifications are possible in the scope of the appended claims.

I claim:

1. An automatic priming system for an outboard marine engine having a manual pull start of the type utilizing a rope wound recoil pulley and a primer button operably connected to a primer bowl of a carburetor so that depression of the primer button causes said engine to be primed, said system comprising, a first means for translating the rotational movement of the recoil pulley into linear movement, priming means having a linearly moving portion in operable engagement with the primer button so that movement of said portion results in depression of the primer button, and linkage means connecting said first means to said linearly moving portion of said priming means so that linear movement of said first means caused by the rotational movement of the recoil pulley results in linear movement of said priming means portion and depression of the primer button.

2. The automatic priming system defined in claim 1 wherein the recoil pulley includes a plurality of camming surfaces disposed about its circumference and said first means comprises, a pivotally mounted cam lever having a first end engageable with the camming surfaces and a second end opposite said first end with said pivot point disposed between said first and second ends so that rotation of the recoil pulley causes movement of said first and second ends, and a first pneumatic cylinder having linearly moving piston head and rod with said rod connected to said second lever end so that movement of said lever causes linear movement of said piston head in said cylinder and an increase in pressure of the fluid in said first cylinder.

3. The automatic priming system defined in claim 1 wherein said priming means comprises a second pneumatic cylinder having a linearly moving piston head and rod with said rod engaging the primer button so that extension of said rod causes depression of the primer button.

4. The automatic priming system defined in claim 2 wherein said priming means comprises a second pneumatic cylinder having a linearly moving piston head and rod with said rod engaging the primer button so that extension of said rod causes depression of the primer button.

5. The automatic priming system defined in claim 4 wherein said linkage means comprises a pneumatic coupling of said first and second cylinders whereby the increase in pressure in said first pneumatic cylinder is communicated to the head side of said second cylinder so as to cause extension of said second cylinder rod.

6. The automatic priming system defined in claim 5 further comprising one-way valve means disposed within said coupling so as to prevent return pneumatic flow from said second cylinder to said first cylinder.

7. The automatic priming system defined in claim 5 or 6 further comprising engine responsive valve means which open in response to a predetermined engine condition and vents said first cylinder to atmosphere.

8. The automatic priming system defined in claim 7 wherein said predetermined engine condition comprises a predetermined engine temperature so that said responsive valve opens to prevent priming of a heated engine.

9. An automatic priming system for an outboard marine engine having a manual pull start of the type utilizing a rope wound recoil pulley having a plurality of camming surfaces disposed about its circumference and a primer button operably connected to a primer bowl of a carburetor so that depression of the primer button causes said engine to be primed, said system comprising, a pivotally mounted cam lever having a first end engageable with the camming surfaces and a second end opposite said first end with said pivot point disposed between said first and second ends so that rotation of the recoil pulley causes movement of said first and second ends, a first pneumatic cylinder having linearly moving piston head and rod with said rod connected to said second lever end so that movement of said lever causes linear movement of said piston head in said cylinder and an increase in pressure of the fluid in said first cylinder, a second pneumatic cylinder having a linearly moving piston head and rod with said rod engaging the primer button so that extension of said rod causes depression of the primer button, and a pneumatic coupling of said first and second cylinders whereby the increase in pressure in said first pneumatic cylinder is communicated to the head side of said second cylinder so as to cause extension of said second cylinder rod.

* * * * *